US010718580B2

(12) United States Patent
Dewalch

(10) Patent No.: US 10,718,580 B2
(45) Date of Patent: Jul. 21, 2020

(54) FEEDER/DELINKER FOR A GATLING GUN

(71) Applicant: Norman Binz Dewalch, Houston, TX (US)

(72) Inventor: Norman Binz Dewalch, Houston, TX (US)

( * ) Notice: Subject to any disclaimer, the term of this patent is extended or adjusted under 35 U.S.C. 154(b) by 0 days.

(21) Appl. No.: 15/901,120

(22) Filed: Feb. 21, 2018

(65) Prior Publication Data

US 2019/0257604 A1 Aug. 22, 2019

(51) Int. Cl.
*F41A 9/36* (2006.01)

(52) U.S. Cl.
CPC ..... *F41A 9/36* (2013.01)

(58) Field of Classification Search
CPC ..... F41A 9/35; F41A 9/36
USPC ..... 89/12, 9, 33.01
See application file for complete search history.

(56) References Cited

U.S. PATENT DOCUMENTS 3,921,499 A * 11/1975 Ginsky ..... F41A 17/16 89/12
6,443,044 B1 * 9/2002 Dillon ..... F41A 9/36 89/12
2017/0205167 A1 * 7/2017 Abbott ..... F41A 9/30
2019/0137204 A1 * 5/2019 Abbott ..... F41A 9/31

* cited by examiner

*Primary Examiner* — Jonathan C Weber
(74) *Attorney, Agent, or Firm* — Kenneth L. Nash

(57) ABSTRACT

A feeder and delinker for use in a gatling gun, the gatling gun comprising a plurality of gun barrels rotatably mounted in a ring, the feeder and delinker comprising: a housing, a drive gear rotationally coupled to the gun barrels rotatably mounted in the ring, the drive gear extending through the housing; a push rod guide and a plurality of push rods oriented parallel to the gun barrels rotatably mounted in the ring. The push rods being slidably received within a corresponding plurality of longitudinal grooves within the push rod guide, the push rod guide being rotationally coupled to the drive gear, at least one of the push rod guide or push rods comprising a friction reducer located between the push-rod and push rod guide, the push rod guide and the plurality of push rods and the shaft being mounted within the housing.

5 Claims, 3 Drawing Sheets

FEEDER/DELINKER FOR A GATLING GUN

BACKGROUND OF THE INVENTION

The present invention relates generally to a gatling gun and more specifically it relates to an improved feeder/delinker for a gatling gun.

A gatling gun is an automatic machine gun that was originally invented by R. J. Gatling in 1862. The galling gun and designs derived from it have been further developed over the years by numerous organizations such as General Electric Company and continue to be important weapons for military applications. This type of gun is well known to those skilled in the art and some examples can be seen in U.S. Pat. No. 125,563 (R. J. Gatling); U.S. Pat. No. 3,595,128 (Hoyt, Jr.); U.S. Pat. No. 9,791,241 (Rowe, et al.).

Modern gatling guns typically fire belted ammunition comprising for example 7.62 mm rounds or 5.56 mm rounds, have a rotary barrel assembly comprised of several barrels, an electric drive motor to rotate the barrels through their firing position and a feeder/delinker to remove the ammunition from the belt and deliver it to the barrel assembly for firing. While modern gatling guns have shown to be generally a reliable weapon they all, from time to time, are susceptible to jamming. The delinker is the most problematic component of the gun and many times jamming can be attributed to malfunctions in the delinker. One such malfunction can be attributed to a self locking condition that can occur between the push rods and the push rod guide in the delinker. The push rods move longitudinally in slots in the push rod guide and experience forces normal to this direction during actuation of the push rods. If the normal force on the push rod multiplied by the coefficient of friction exceeds the longitudinal force on the push rod the rod will not move and be locked in place. Materials that have sufficient strength to handle the forces in the guide and push rod do not usually have desirable friction properties. This is particularly problematic when the cam angle of the push rod drive surface is too steep. The prior art has relied on lubrication to try to solve this problem however if the lubrication becomes insufficient the frictional forces can increase beyond the threshold for locking and the delinker will jam.

There remains a need for an apparatus and method for eliminating this locking condition to improve the reliability of a feeder/delinker for a gatling gun.

Those of skill in the art will appreciate the example embodiments of the present invention which addresses the above needs and other significant needs the solution to which are discussed hereinafter.

SUMMARY OF THE INVENTION

The present invention provides, in a non-limiting example embodiment, which will be described subsequently in greater detail, a system, method and apparatus to significantly reduce the friction between a push rod and push rod guide in a feeder/delinker for a gatling gun and thereby reducing instances of jamming.

To attain this, one non-limiting embodiment of the present invention comprises a push rod and a push rod guide having longitudinal grooves for receiving the push rods. At least one ball is placed between each of the push rods and the push rod guide thereby reducing sliding friction between the two members.

In another example embodiment, at least one cylindrical roller is placed between each of the push rods and the push rod guide thereby reducing sliding friction between the two members.

In another example embodiment, a rod is placed longitudinally between the two members.

In another example embodiment, an insert is placed between the two members.

In another example embodiment, a material having a lower coefficient of friction than the push rod and push rod guide is placed between the two members.

In another example embodiment, a surface treatment is applied to the push rod, push rod guide or both.

The content and disclosure of each of the following applications to the extent permitted are specifically hereby incorporated by reference: U.S. Pat. Nos. 125,563; 6,443,044; 9,671,185.

Additionally, all written material, figures, content and other disclosure in each of the above-referenced applications, is hereby incorporated by reference. In addition, the instant application claims priority as noted above.

There has thus been outlined, rather broadly, features of example embodiments of the invention in order that the detailed description thereof may be better understood, and in order that the present contribution to the art may be better appreciated. There are additional features of example embodiments of the invention that will be described hereinafter.

In this respect, before explaining at least one example embodiment of the invention in detail, it is to be understood that the example embodiments are not limited in its application to the details of construction and to the arrangements of the components set forth in the following description or illustrated in the drawings. Various example embodiments are capable of other further embodiments and of being practiced and carried out in various ways. Also, as emphasized, it is to be understood that the phraseology and terminology employed herein are for the purpose of the description and should not be regarded as limiting.

To the accomplishment of the above and related objects, example embodiments of the invention may be embodied in the form illustrated in the accompanying drawings, attention being called to the fact, however, that the drawings are illustrative only, and that changes may be made in the specific construction illustrated.

Other aspects and advantages of the present invention will become obvious to the reader and it is intended that these aspects and advantages are within the scope of the present invention.

These and other aspects, features, and advantages of example embodiments of the present invention will become apparent from the drawings, the descriptions given herein, and the appended claims. Further aspects are also indicated herein in various example embodiments of the invention. However, it will be understood that the above-listed objectives and/or advantages of example embodiments are intended only as an aid in quickly understanding aspects of the example embodiments, are not intended to limit the embodiments of the invention in any way, and therefore do not form a comprehensive or restrictive list of objectives, and/or features, and/or advantages.

BRIEF DESCRIPTION OF THE DRAWINGS

Various aspects, example embodiments and other example embodiments, features and attendant advantages of the embodiments of the invention will become fully appreciated as the same becomes better understood when considered in conjunction with the accompanying drawings, and wherein.

While various example embodiments of the invention will be described herein, it will be understood that it is not intended to limit the invention to those embodiments. On the contrary, it is intended to cover all alternatives, modifications, and equivalents included within the spirit of the invention.

DETAILED DESCRIPTION OF THE INVENTION

Figure 1:
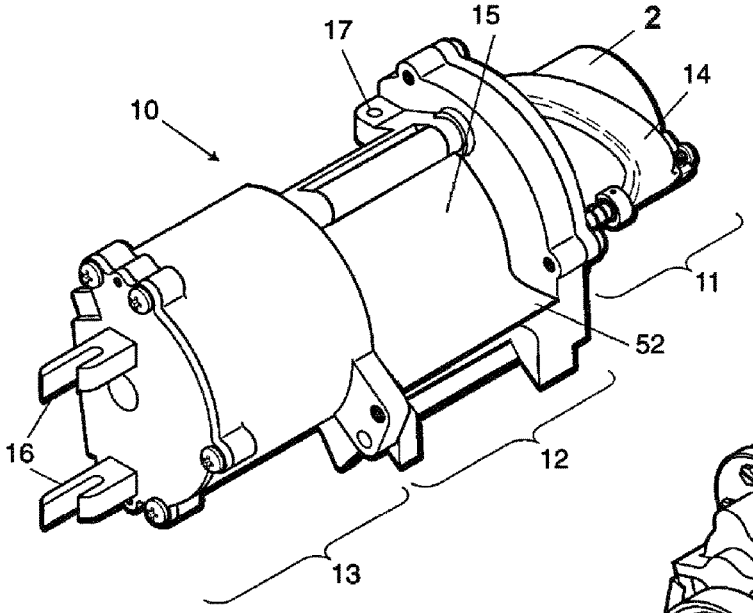
FIG. 1 is a perspective view of an example embodiment feeder/delinker.

Turning now descriptively to the drawings, in which similar reference characters may denote similar elements throughout the several views, the attached figures illustrate a feeder/delinker for a gatling gun. FIG. 1 discloses an improved example embodiment feeder/delinker 10 of the invention comprising a drive stage 11, a delinker stage 12 and a delivery stage 13. Other features of feeder/delinker 10 which are visible in FIG. 1 include the external contours of a ramped or spiraled push-rod drive channel 14, hatch door 15, forward mounting hooks 16 and rearward mounting hole 17, hooks 16 and hole 17 being provided for use in mounting feeder/delinker 10 to a gatling gun 18 as shown in FIG. 2.

Figure 2:
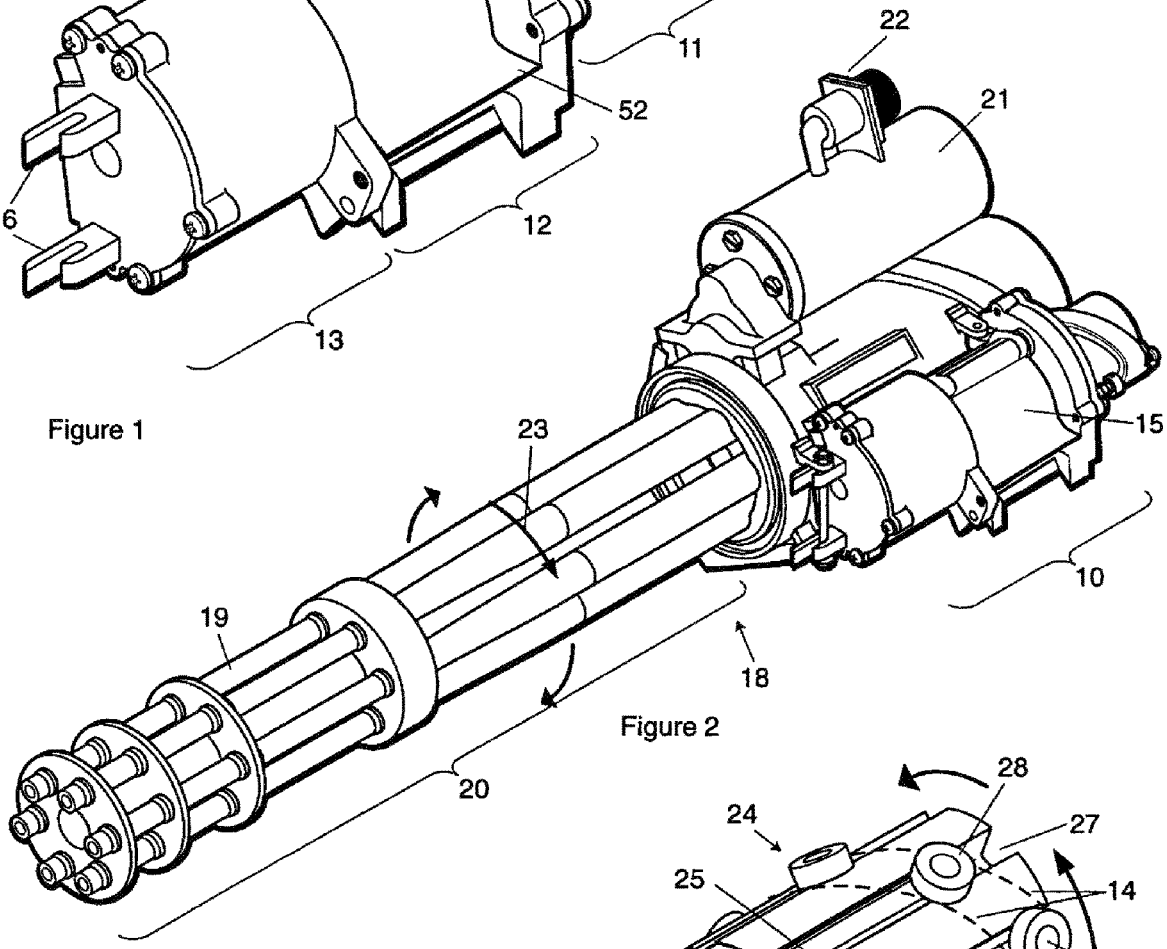
FIG. 2 is a perspective view of an example embodiment feeder/delinker installed on a gatling gun.

FIG. 2, shows an example embodiment feeder/delinker 10 mounted to gatling gun 18, the feeder/delinker 10 is an essential component of gun 18 and serves to delink ammunition from a belt and deliver it to the gatling gun to be fired. Other elements of gatling gun 18 include a rotatable ring 20 of barrels 19, a drive motor 21 and an electrical connector 22. Rotatable ring 20 has an axis in parallel alignment with the axis of barrels 19.

In the operation of gatling gun 18, drive motor 21 causes ring 20 of barrels 19 to rotate as indicated by an arrow 23. Responding to the rotation of ring 20 of barrels 19, gatling gun 18 fires each barrel 19 sequentially in rapid succession. At the same time, feeder/delinker 10 receives a continuous string of linked ammunition which it delinks and feeds to gatling gun 18.

Figure 3:
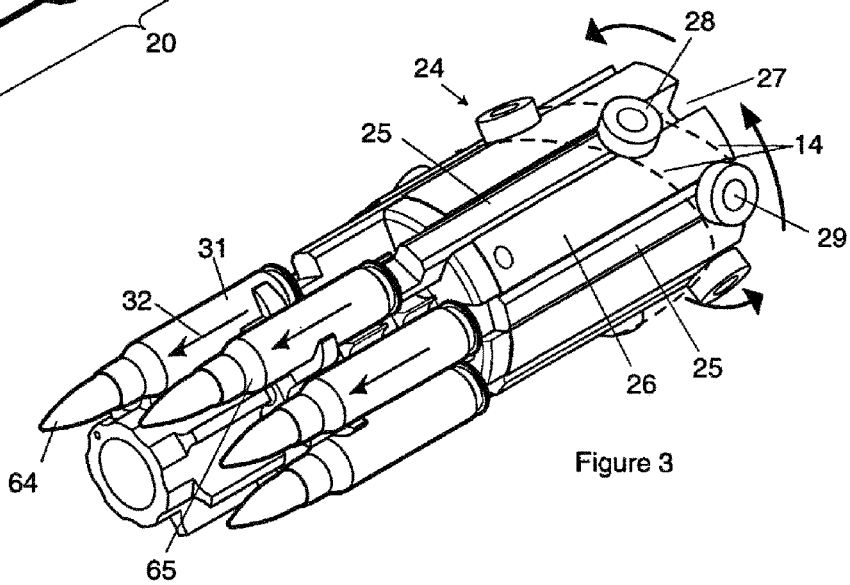
FIG. 3 is a perspective view of a functional illustration of an example embodiment feeder/delinker drive mechanism with its drive gear removed.
Figure 4:
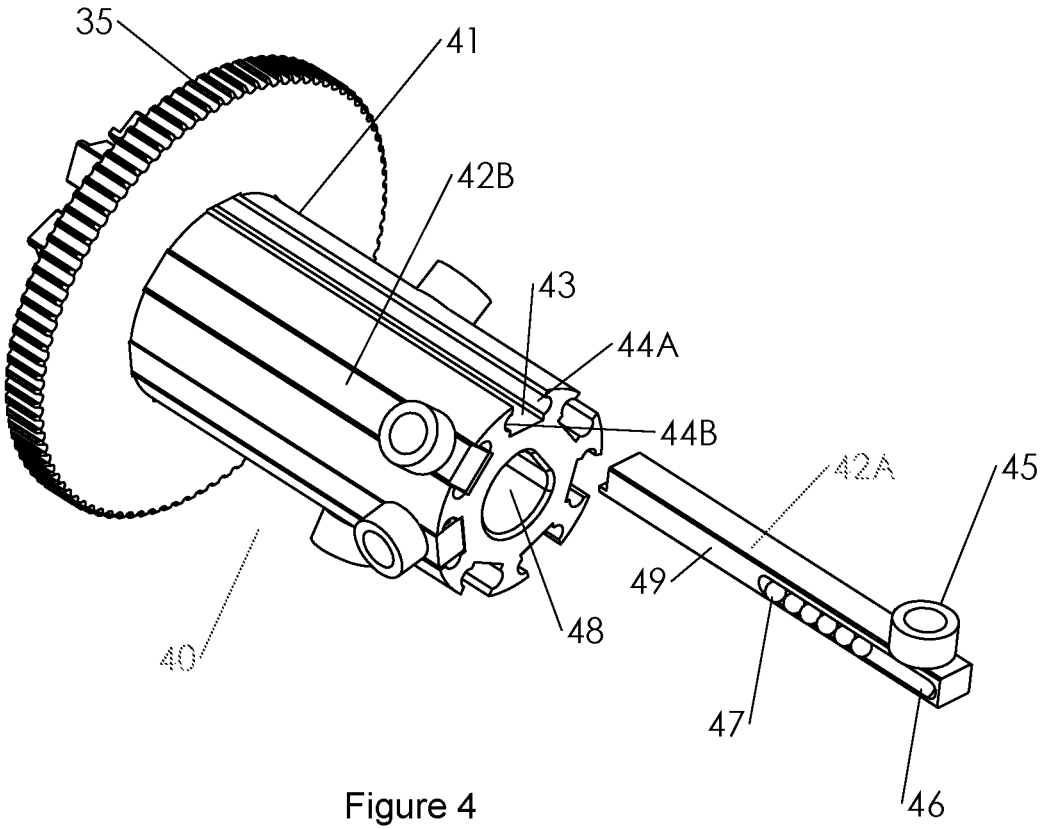
FIG. 4 is a perspective view of an example embodiment push rod guide and push rods with ball friction reducers.

The drive stage 11 shown in FIG. 1 comprises a drive stage housing 2, and drive mechanism. FIG. 3 shows an example drive mechanism 24 with its drive gear removed. FIG. 4 shows an example embodiment drive mechanism 40 with drive gear 35 in place. When assembled, the drive mechanism is mounted within the drive stage housing such as 2 in FIG. 1. The drive mechanism 24 comprises a set of push rods 25 and a push rod guide 26. Push rod guide 26 comprises a cylindrical body having an axis in parallel alignment with the axis of ring 20. Rods 25 move longitudinally inside longitudinal grooves 27 which are uniformly distributed about the cylindrical surface of the cylindrical body.

Each rod 25 has a drive wheel 28 secured to its rearward end by means of an axle 29 that extends outwardly from the outer face of the rod. Wheels 28 are confined within spiral grooved push rod channel 14 represented, in FIG. 3, by the broken lines 14'. Spiral grooved channel 14 is incorporated drive stage 11. As push rod guide 26 rotates about its axis by means of drive motor 21, push rods 25 are constrained by wheels 28 to follow the path of channel 14, thereby moving forward and backward with each rotation of push rod guide 26. As push rods 25 move forwardly, push rods 25 engage the rear of a cartridge 31 and push cartridge 31 forwardly as indicated by arrows 32. As each cartridge 31 is driven forwardly, that cartridge 31 is freed, or delinked, from the linkage and then handed off to the gatling gun 18.

The benefits of the present invention will be appreciated by those skilled in the art and has particular benefit in feeder/delinkers for guns where size and weight are important. To reduce weight, the size of the feeder/delinker is reduced which typically results in the reduction of the diameter of the drive stage housing. Since the length of the ammunition is fixed a reduction in the diameter of the drive stage housing results in the steepening of the angle of the helix that defines the contour push-rod drive channel. This steepening of the helix angle increases the frictional forces on the push rod in the push rod guide and can make operation more difficult or in some cases impossible due to the frictional forces between the push rod and the push rod guide. The present invention reduces the friction forces and improves the operation the feeder/delinkers that incorporate it.

FIG. 4 shows an example embodiment push rod guide and push rod assembly 40 it comprises push rod guide 41 and in the present embodiment 7 push rods such as 42A and 42B. For ease of illustration and clarity 7 push rods and push rod grooves are shown in the example embodiments however any number of push rods and push rod grooves may be used as required and the present invention is not limited by the number of push rods and push rod grooves used in the assembly. Push rod guide 41 is shown as an example embodiment with longitudinal hole 48 with a "D" shaped cross sectional shape to receive the shaft of a drive rod as is well understood by those skilled in the art. Other means of coupling the drive rod to the push rod guide including other shapes and making the drive rod and push rod a single integral piece will be obvious to those skilled in the art. Each push rod is slidably received within a corresponding longitudinal groove such as 43 within the push rod guide 41. When force is exerted upon wheel 45 by push the push rod channel in the drive stage housing the push rod is moved longitudinally in groove 43 forward and back to exert force on the rear of a cartridge and thereby remove it from a linked belt. As force is exerted on roller 45 reaction forces arise between the push rods such as 42A and the longitudinal grooves in the push rod guide such as 43. Frictional forces arise between these members and resist the movement of the push rods. To reduce frictional forces between these members a friction reducer has been placed between the push rod and push rod guide to minimize direct contact. The friction reducer shown in the present embodiment comprises balls such as 47 and ball grooves in the push rod such as 46. The push rod guide 41 comprises grooves such as 44A and 44B that correspond to grooves such as 47 in the push rods and receive the balls. These structures are located between the push rod guide and push rod as illustrated. Most if not all of the contact between the push rod and push rod guide is through the ball friction reducers.

Figure 5:
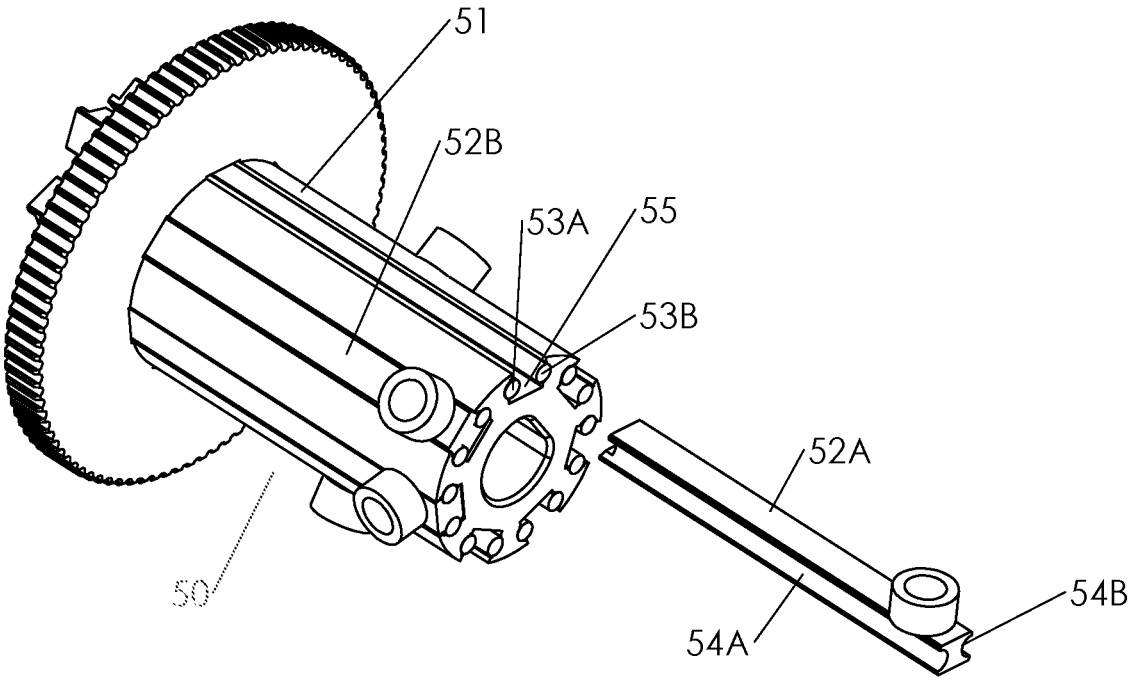
FIG. 5 is a perspective view of an example embodiment push rod guide and push rods with inserted rod friction reducers.

FIG. 5 shows an example embodiment push rod guide and push rod assembly 50. The present embodiment comprises push rod guide 51 and push rods such as 52A and 52B each push rod is slidably received within a corresponding longitudinal groove such as 55. The push rods such as 52A comprise longitudinal grooves such as 54A and 54B which receive rods 53A and 53B when the push rod is inserted into its groove such as 55. Rods 53A and 53B are inserted into the walls of push rod groove 55 in push rod guide 51 and are thus located between the push rod and push rod guide. Rods 53A and 53B serve to reduce friction between the push rod and push rod guide. Friction can be further reduced by using a material for rods 53A and 53B that has a lower coefficient of friction than the materials used for the push rod guide and push rods. Some example embodiment rods comprise hardened steel, tungsten carbide, bronze, plastics, ceramic materials or materials with surface treatments such as carburizing, carbo-nitriding, nitrided surfaces, or vapor deposited surfaces such as titanium nitride as well as other physical and chemically applied coatings.

Figure 6:
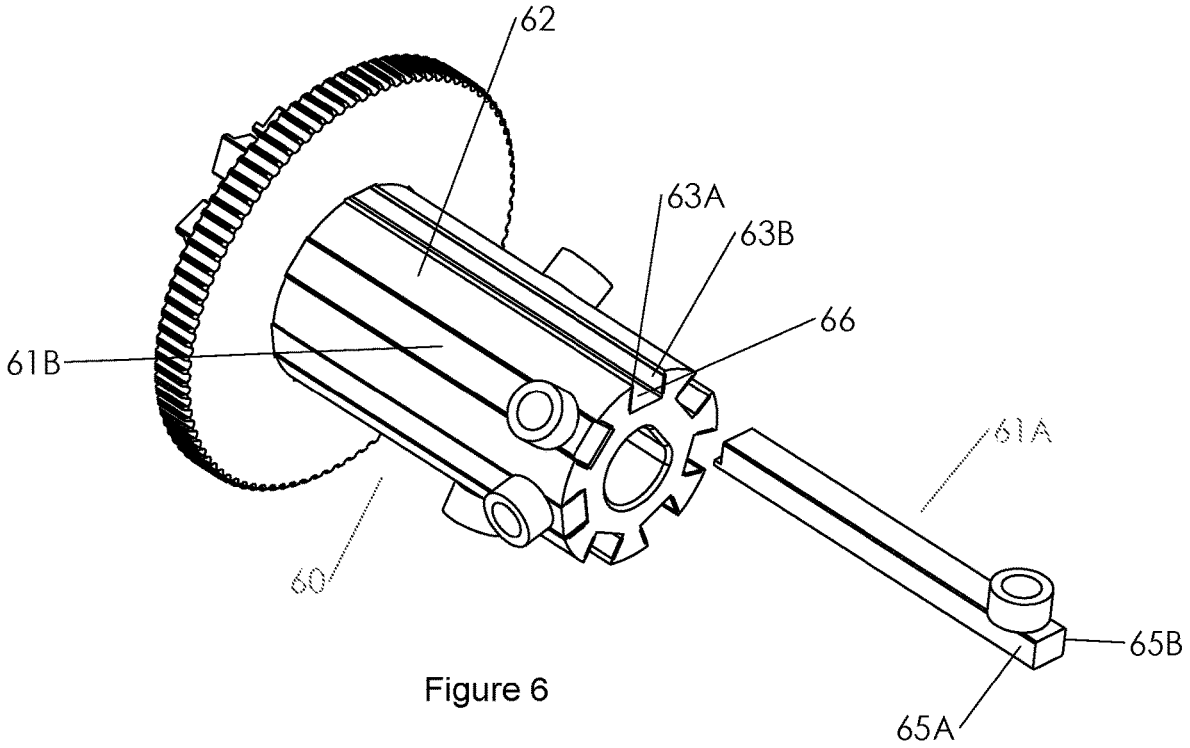
FIG. 6 is a perspective view of an example embodiment push rod guide and push rods with inserted flat friction reducers.

FIG. 6 shows an example embodiment push rod guide and push rod assembly 60. The present embodiment comprises push rod guide 62 and push rods such as 61A and 61B each push rod is slidably received within a corresponding longitudinal groove such as 66. The push rods such as 61A have flat surfaces such as 65A 65B which contact flat inserts 63A and 63B when the push rod is inserted into its groove such as 66. Inserts 63A and 63B are inserted into the walls of push rod groove 66 in push rod guide 62 and are thus located between the push rod and push rod guide. Inserts 63A and 63B serve to reduce friction between the push rod and push rod guide. Friction can be further reduced by using a material for inserts 63A and 63B that has a lower coefficient of friction than the materials used for the push rod guide and push rods. Some example embodiment inserts comprise hardened steel, tungsten carbide, bronze, plastics, ceramic materials or materials with surface treatments such as carburizing, carbo-nitriding, nitrided surfaces, or vapor deposited surfaces such as titanium nitride as well as other physical and chemically applied coatings.

Figure 7:
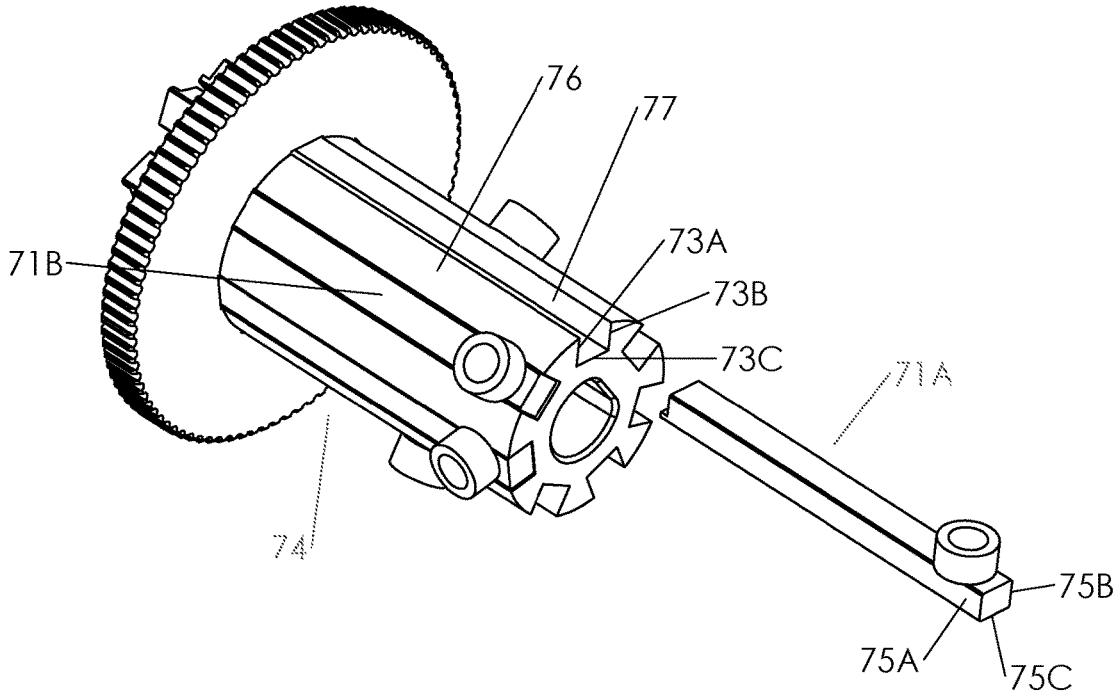
FIG. 7 is a perspective view of an example embodiment push rod guide and push rods with surface treatment friction reducer.

FIG. 7 shows an example embodiment push rod guide and push rod assembly 74. The present embodiment comprises push rod guide 76 and push rods such as 71A and 71B each push rod is slidably received within a corresponding longitudinal groove such as 77. The push rods such as 71A have flat surfaces such as 75A, 75B and 75C which contact surfaces 73A, 73B and 73C when the push rod is inserted into its groove such as 77. In the present embodiment surfaces 73A, 73B and 73C are treated with a substance that has a lower coefficient of friction than the coefficient of friction between the materials used for the push rod guide and push rods. Surface treatments to surfaces 73A, 73B and 73C are located on the surfaces of push rod 71A and when it is inserted into push rod groove 77 the friction reducing coating is thus located between the push rod and push rod guide.

Examples of surface treatments comprise treatments such as applications of materials such as tungsten carbide, bronze, plastics, ceramic materials integrally bonded to the surface. Other treatments comprise diffusion coatings such as carburizing, carbo-nitriding or nitriding still further examples comprise vapor deposited surfaces such as titanium nitride, zirconium nitride, chromium nitride, titanium aluminum nitride as well as other physical and chemical vapor deposited coatings.

Other example embodiment surface treatments comprise treatments to the surfaces of groove 77 such as 73A, 73B and 73C. Further embodiments comprise treatments to both the grooves in the push rod guide and the push rod surfaces. Treatments may be the same substance or different substances on each of the push rod guide and push rod.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The foregoing disclosure and description of embodiments of the invention is illustrative and explanatory of the above and variations thereof, and it will be appreciated by those skilled in the art, that various changes in the design, organization, order of operation, means of operation, equipment structures and location, methodology, the use of mechanical equivalents, such as different types of other feeder/delinkers and gatling guns than as illustrated whereby different steps may be utilized, as well as in the details of the illustrated construction or combinations of features of the various elements may be made without departing from the spirit of the embodiments of the invention. As well, the drawings are intended to describe various concepts of embodiments of the invention so that presently preferred embodiments of the invention will be plainly disclosed to one of skill in the art but are not intended to be manufacturing level drawings or renditions of final products and may include simplified conceptual views as desired for easier and quicker understanding or explanation of embodiments of the invention. As well, the relative size and arrangement of the components may be varied from that shown and the embodiments of the invention still operate well within the spirit of the embodiments of the invention as described hereinbefore and in the appended claims. Thus, various changes and alternatives may be used that are contained within the spirit of the embodiments of the invention.

Accordingly, the foregoing specification is provided for illustrative purposes only, and is not intended to describe all possible aspects of the example embodiments of the invention. It will be appreciated by those skilled in the art, that various changes in the ordering of steps, ranges, interferences, spacings, hardware, and/or attributes and parameters, as well as in the details of the illustrations or combinations of features of the methods and system discussed herein, may be made without departing from the spirit of the embodiments of the invention. Moreover, while various embodiments of the invention have been shown and described in detail, those of ordinary skill in the art will appreciate that changes to the description, and various other modifications, omissions and additions may also be made without departing from either the spirit or scope thereof.

REFERENCES

The following references and those included in the Summary of Invention, to the extent that they provide exemplary procedural or other details supplementary to those set forth herein, are specifically incorporated herein by reference.

U.S. Pat. Nos. 6,443,044; 125,563; 9,671,185; 3,595,128; 9,791,241

What is claimed is:

1. A feeder and delinker for use in a gatling gun, the gatling gun comprising a plurality of gun barrels rotatably mounted in a ring, the feeder and delinker comprising:

a drive stage;

a drive gear rotationally coupled to the plurality of gun barrels rotatably mounted in the ring;

a push rod guide and a plurality of push rods oriented parallel to the plurality of gun barrels rotatably mounted in the ring, the plurality of push rods being slidably received within a corresponding plurality of longitudinal grooves within the push rod guide, the push rod guide being rotationally coupled to the drive gear; and at least one of the push rod guide or push rods comprising a friction reducer located between the push rod and push rod guide, said friction reducer comprising a solid insert, planar surface, or an apparatus that results in a lower coefficient of friction when placed between the push rod and push rod guide than a coefficient of friction of the push rod or the push rod guide, the push rod guide and the plurality of push rods and a shaft being mounted within the drive stage.

2. The feeder and delinker of claim 1, further comprising said friction reducer comprises a plurality of rollers mounted within a plurality of grooves within said plurality of push rods, a plurality of grooves within said push rod guide to accept said plurality of rollers, wherein said plurality of rollers engage said plurality of grooves within said push rod guide.

3. The feeder and delinker of claim 1, further comprising said friction reducer comprises a plurality of rods mounted within a plurality of grooves within said push rod guide, a plurality of grooves within said plurality of push rods to accept said plurality of rods, wherein said plurality of rods within said push rod guide engage said plurality of grooves within said plurality of push rods.

4. The feeder and delinker of claim 1, further comprising said friction reducer comprises a plurality of inserts mounted within a plurality of walls in said push rod guide, wherein said plurality of inserts engage said plurality of push rods when in operation, said inserts comprising a first material having a lower coefficient of friction than a second material used for said push rod guide and said plurality of push rods.

5. The feeder and delinker of claim 1, further comprising said friction reducer comprises a treatment of a coating on a plurality of walls of said push rod guide, wherein said treatment of coating comprises a substance with a lower coefficient of friction than a coefficient of friction of a material used for said push rod guide and said plurality of push rods.

* * * * *